US008151370B2

(12) United States Patent
Perazzo

(10) Patent No.: US 8,151,370 B2
(45) Date of Patent: Apr. 10, 2012

(54) DINING BIB

(76) Inventor: John Perazzo, Southlake, TX (US)

( * ) Notice: Subject to any disclaimer, the term of this patent is extended or adjusted under 35 U.S.C. 154(b) by 0 days.

(21) Appl. No.: 12/884,968

(22) Filed: Sep. 17, 2010

(65) Prior Publication Data

US 2011/0067161 A1 Mar. 24, 2011

Related U.S. Application Data

(60) Provisional application No. 61/276,832, filed on Sep. 18, 2009.

(51) Int. Cl.
*A41B 13/10* (2006.01)

(52) U.S. Cl. ..... 2/49.1; 2/49.2; 2/49.3

(58) Field of Classification Search ..... 2/49.1–49.5, 2/51, 52, 48, 46, 114, 174, 50; 297/182, 297/153; 4/519–521, 655, 658, 580, 581, 4/583, 245.1, 245.3–245.5, 245.7–245.9
See application file for complete search history.

(56) References Cited

U.S. PATENT DOCUMENTS

| | | | | | |
|---|---|---|---|---|---|
| 83,120 | A | * | 10/1868 | Mott | 2/49.5 |
| 563,644 | A | * | 7/1896 | Birney | 2/49.2 |
| 590,991 | A | * | 10/1897 | Lenhart | 2/49.2 |
| 615,293 | A | * | 12/1898 | Maier | 2/49.2 |
| 1,108,857 | A | | 8/1914 | Dudley | |
| 2,105,029 | A | * | 1/1938 | Doty | 2/49.5 |
| 2,321,670 | A | | 6/1943 | Gibson | |
| 2,457,725 | A | | 12/1948 | Rhowmine | |
| 2,594,053 | A | * | 4/1952 | McKewen | 2/49.5 |
| 2,629,871 | A | | 3/1953 | Greene | |
| 2,643,384 | A | | 6/1953 | Thompson | |
| 2,672,614 | A | | 3/1954 | Zimmerman et al. | |
| 2,738,511 | A | | 3/1956 | Brady | |
| 2,762,053 | A | | 9/1956 | Lipscomb | |
| 2,766,455 | A | | 10/1956 | Klaine | |
| 2,767,403 | A | | 10/1956 | Givens | |
| 2,822,548 | A | | 2/1958 | Rhowmine | |
| 2,905,943 | A | | 9/1959 | Carlisle et al. | |
| 3,597,763 | A | | 8/1971 | Bienvenu | |
| 3,995,321 | A | * | 12/1976 | Johnson | 2/49.5 |
| 4,094,547 | A | | 6/1978 | Zampino et al. | |
| 4,114,199 | A | | 9/1978 | Malan | |
| 4,165,123 | A | | 8/1979 | Hutson | |
| 4,301,544 | A | * | 11/1981 | Burton | 2/49.5 |
| 5,107,545 | A | * | 4/1992 | Potter | 2/46 |
| 5,146,629 | A | | 9/1992 | Barnes | |
| 5,469,580 | A | | 11/1995 | Sobol | |
| 5,915,530 | A | | 6/1999 | Hager | |
| 6,081,923 | A | * | 7/2000 | Marks | 2/49.3 |
| 6,105,165 | A | * | 8/2000 | Johnson et al. | 2/49.2 |
| 6,128,781 | A | | 10/2000 | Spindler | |
| 6,209,133 | B1 | * | 4/2001 | Hinshaw | 2/49.1 |
| 6,532,595 | B1 | | 3/2003 | Holmes | |

(Continued)

*Primary Examiner* — Amy Vanatta
(74) *Attorney, Agent, or Firm* — Whitaker Chalk Swindle & Schwartz; Stephen S. Mosher

(57) ABSTRACT

A dining bib comprising a table cover approximating an individual place mat for a dining position; a bib extension of said table cover; a trough formed between a rearward side of said table cover and a lower portion of said bib extension for accumulating food or liquid debris. The trough extends downward from an upper perimeter thereof, and said table cover, bib extension and trough are formed of a water repellant fabric into a single structure. In one embodiment a drawstring closure surrounds the trough to enable closing it. A bolster disposed around the perimeter of the table cover on the left, forward, and right sides thereof forms a basin of the table cover, bib extension, and bolster in combination.

29 Claims, 5 Drawing Sheets

U.S. PATENT DOCUMENTS 6,581,210 B2 6/2003 Kaloustian
6,708,341 B1 3/2004 Schaller
7,469,425 B2 12/2008 DeStefano
7,484,249 B1 2/2009 Reese et al.

* cited by examiner

DINING BIB

This U.S. patent application is related to U.S. Pat. No. 7,716,749 entitled DINING GARMENT FOR A HIGH CHAIR, issued May 18, 2010 to the same inventor as in the present application and claims the benefit of U.S. Provisional Patent Application Ser. No. 61/276,832 filed Sep. 18, 2009.

BACKGROUND OF THE INVENTION

1. Field of the Invention

The present invention generally relates to dining bibs or garments for use by children or older persons during meals and more particularly to a combined bib and table cover.

2. Background and Description of the Prior Art

A variety of bib garments have been developed or proposed for use by infants or young children seated in a high chair to protect their clothing and/or furniture from food and liquid spills, drooling, and the like. Bibs are often equipped with an apron or other extension to spread over a tray or table or under dishware to enhance their utility. In some examples, the extended bib has fence-like sides attached to better retain food items discarded or not yet eaten from leaking or falling off or being pushed away from the bib or its extension.

Such foregoing features are disclosed in the prior art, including the following representative examples. U.S. Pat. No. 2,672,614 issued to Zimmerman et al. describes a "Bib" having a curved form to fit around the body of the wearer. A tray panel is provided around the lower portion of the bib. The tray panel has a bottom surface and a reinforced "upstanding flange" extending from the perimeter of the bottom surface, which is connected to a lower side of the bib nearest its rearward edges, forming a container to catch and retain food particles or liquid foods.

U.S. Pat. No. 2,738,511 issued to Brady describes a one-piece bib that has a tray portion extending from the lower part of the bib that includes a pocket on the underside that may be slipped over the tray and pulled rearward until the tray is completely enclosed by the pocket. The bib is also configured to form a second pocket at the lower portion of the bib between the near edge of the tray and the bib to catch food particles and liquids. A bowl retainer comprising a circular piece of flexible material having an outer peripheral edge, which includes a drawstring, is provided to secure a bowl of food to the top side of the tray portion of the bib.

U.S. Pat. No. 2,766,455 issued Klaine for an "Infant's Bib and Auxiliary Tray" having inflatable, tubular sidewalls which serve to form a confining basin extending over the upper surface of the tray of the high chair. A tray frame is required for supporting the auxiliary tray in position. The confining basin may be collapsed for storage. The tray cover itself is preferably formed of a sheet of flexible plastic material. A valve is provided for inflating and deflating the inflatable sidewalls.

U.S. Pat. No. 2,905,943 issued to Carlisle et al. describes a "Combined Bib and Apron." The apron portion is configured to fit over the tray of a high chair and secured by elastic strips around the edge of the apron. The one piece bib and apron includes sufficient material to provide a trough between the child's waist and the near edge of the tray of the high chair. The combined bib and apron is made of a single sheet of waterproof material.

The foregoing bib-and-apron combinations have one or more of the following inconvenient features. Those that have a sidewall either require inflation of the sidewall and a supporting frame for the sidewall, a stiffener internal to a laminated sidewall, or lack any kind of support for the sidewall.

Thus, the sidewall feature requires a set up operation to use, is insufficiently flexible or has relatively hard edges, or the sidewall is rendered ineffective as a containing mechanism because of its lack of support. In addition, those bib-and-apron combinations that are reusable require bailing out of the trough or basin, or removal from the high chair, to dispose of spilled food items. What is needed is a bib and tray cover combination that solves these problems and increases the utility and ease of use without diminishing the comfort to the child that is using it.

U.S. Pat. No. 7,716,749 issued to the inventor of the present application, addressed the foregoing deficiencies by providing a dining garment for a child's high chair or toddler's table or other similar furniture article, comprising a tray cover, a bib extension of the tray cover extending over the tray, and a bolster disposed around and extending upward from the perimeter of the tray cover, the combination forming a basin. The bolster has sufficient rigidity to maintain the basin form and sufficient flexibility to facilitate installation, removal, and cleaning, without requiring inflation of the bolster and without requiring a separate supporting frame. The dining garment included a trough between the tray cover and the bib extension for accumulating spilled food materials. A drain may be provided in the trough for draining the spilled food debris. U.S. Pat. No. 7,716,749 is incorporated herein in its entirety by reference for all that it discloses.

However, the structure of the dining garment disclosed in the '749 patent is not well-adapted to use with an older child seated at a conventional dining table, nor is it easy to contain the food debris in the garment's basin and trough until it can be drained for cleaning. Accordingly, improvements to the structure of the dining garment to extend its utility for toddlers, older children, children or persons with special needs, etc. may be made as described herein below and claimed in the appended claims.

SUMMARY OF THE INVENTION

Accordingly, a dining bib is disclosed comprising a table cover having a shape and size approximating an individual place mat for a dining position; a bib extension of said table cover extending upward proximate a rearward side of said table cover; a trough formed between said rearward side of said table cover and a lower portion of said bib extension for accumulating food or liquid debris spilled upon said table cover or said bib extension, wherein an upper perimeter of said trough is defined by the junction of said trough with said rearward side of said table cover and said lower portion of said bib extension, said trough extending downward from said upper perimeter, and said table cover, bib extension and trough are formed of a water repellant fabric into a single structure; a drawstring closure mechanism surrounding and retained within said upper perimeter of said trough to enable closing said trough; and a bolster disposed around and extending upward from the perimeter of said table cover on the left, forward , and right sides thereof, wherein a first end and a second end of said bolster are attached to said bib extension at respective left and right sides thereof, thereby forming a basin by said table cover, bib extension, and bolster in combination.

In another embodiment, a dining bib is disclosed comprising: a table cover having a shape and size approximating an individual place mat for a dining position; a bib extension of said table cover extending upward proximate a rearward side of said table cover; a trough formed between said rearward side of said table cover and a lower portion of said bib extension for accumulating food or liquid debris spilled upon said table cover or said bib extension, wherein an upper perimeter of said trough is defined by the junction of said trough with said rearward side of said table cover and said lower portion of said bib extension, said trough extending downward from said upper perimeter, and said table cover, bib extension and trough are formed of a water repellant fabric into a single structure; a bolster disposed around and extending upward from the perimeter of said table cover on the left, forward , and right sides thereof, wherein a first end and a second end of said bolster are attached to said bib extension at respective left and right sides thereof, thereby forming a basin by said table cover, bib extension, and bolster in combination; and a plurality of releasable fasteners disposed under the perimeter of said table cover to enable securing said table cover portion of said dining bib to a table surface during use.

In yet another alternate embodiment there is disclosed a dining bib, comprising: a table cover having a shape and size approximating an individual place mat for a dining position; a bib extension of said table cover extending upward proximate a rearward side of said table cover; a trough formed between said rearward side of said table cover and a lower portion of said bib extension for accumulating food or liquid debris spilled upon said table cover or said bib extension, wherein an upper perimeter of said trough is defined by the junction of said trough with said rearward side of said table cover and said lower portion of said bib extension, said trough extending downward from said upper perimeter, and said table cover, bib extension and trough are formed of a water repellant fabric into a single structure; a drawstring closure mechanism surrounding said upper perimeter of said trough to enable closing said trough; a bolster disposed around and extending upward from the perimeter of said table cover on the left, forward , and right sides thereof, wherein a first end and a second end of said bolster are attached to said bib extension at respective left and right sides thereof, thereby forming a basin by said table cover, bib extension, and bolster in combination; and a plurality of releasable fasteners disposed under the perimeter of said table cover to enable securing said table cover portion of said dining bib to a table surface during use.

DETAILED DESCRIPTION OF THE INVENTION

A dining bib is disclosed having a table cover approximating an individual place mat for a dining position, a bib extension of the table cover, and a trough formed between a rearward side of the table cover and a lower portion of the bib extension for accumulating food or liquid debris. The trough extends downward from an upper perimeter thereof, and the table cover, bib extension and trough are formed of a water repellant fabric into a single structure. In one embodiment a drawstring closure surrounds the trough to enable closing it. A bolster disposed around the perimeter of the table cover on the left, forward, and right sides thereof forms a basin of the table cover, bib extension, and bolster in combination. In another embodiment releasable fasteners such as suction cups are provided to secure the dining bib to a table surface. In the following description, reference numbers appearing in multiple views that are the same refer to the same structures.

Figure 1:
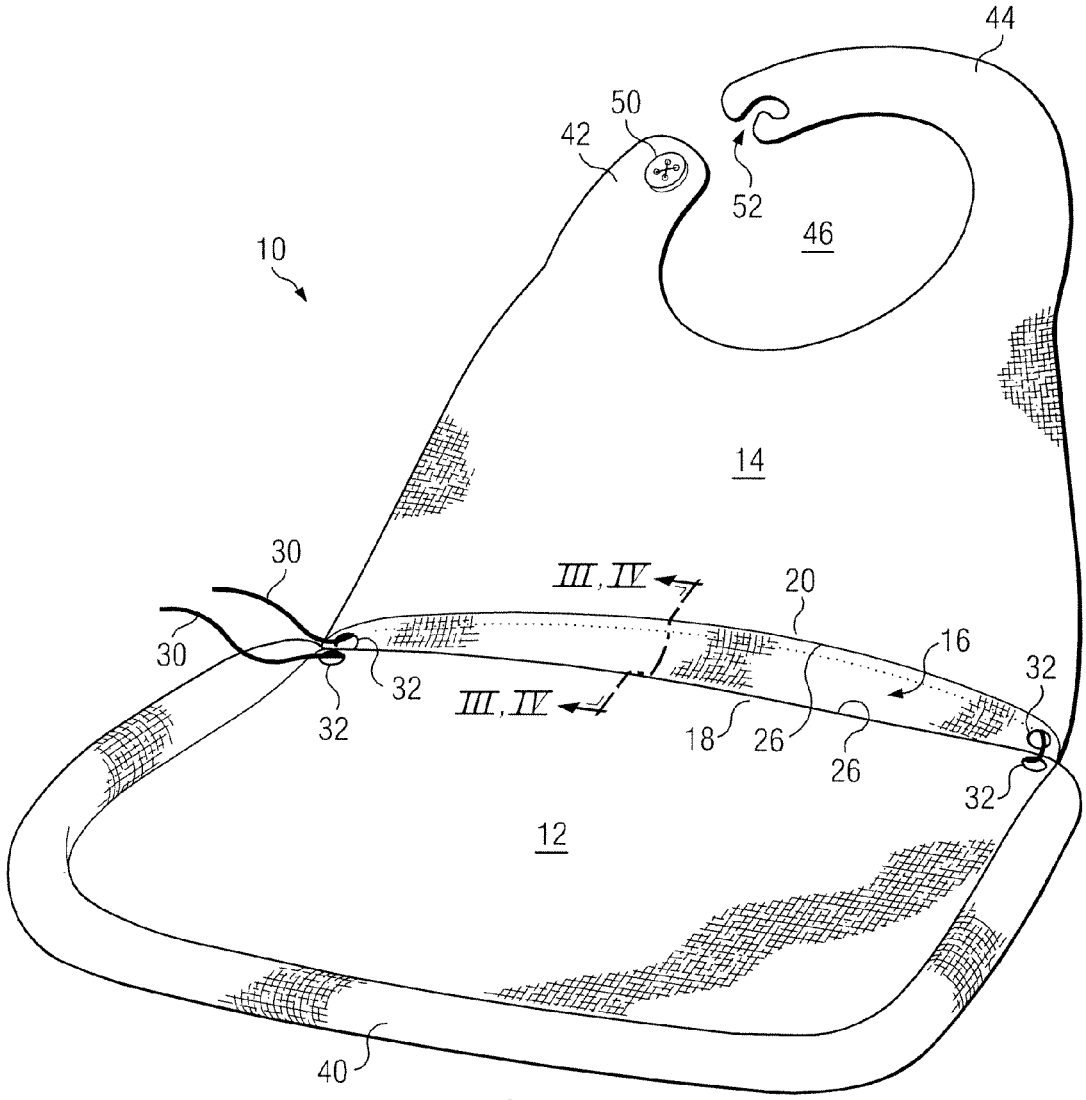
FIG. 1 illustrates one embodiment of a dining bib according to the present invention.

FIG. 1 illustrates one embodiment of a dining bib 10 according to the present invention. A table cover 12 is adjoined to a bib extension 14 through a trough 16. The preferred material is a lightweight, urethane-coated, 70 Denier, 100% nylon fabric, available from various manufacturers and distributors. A suitable alternate material is called a high count nylon taffeta. Other materials that are equivalent may be suitable. However, fabrics containing polyvinyl chloride ("PVC") or any other material containing any of the phthalate family of chemical compounds should be avoided because of their potential toxicity, especially to young children. The use of phthalates is restricted in California, for example. The present invention is adapted primarily to toddlers and young children old enough to be seated at a dining table while seated on a booster chair, or disabled persons that need a protective bib device while dining. The panels forming the table cover 12, the trough 16, and the bib extension are sewn together along tight-fitting seams 26 that resist leakage of fluid debris from the trough 16. One seam 26 is disposed along rearward side 18 of the table cover 12. Another seam 26 is disposed along the lower portion 20 of the bib extension 14. In an alternate embodiment for ease of manufacture, for example, an additional seam (not shown) may be located along the bottom-most portion of the trough 16 from end-to-end.

Figure 3:
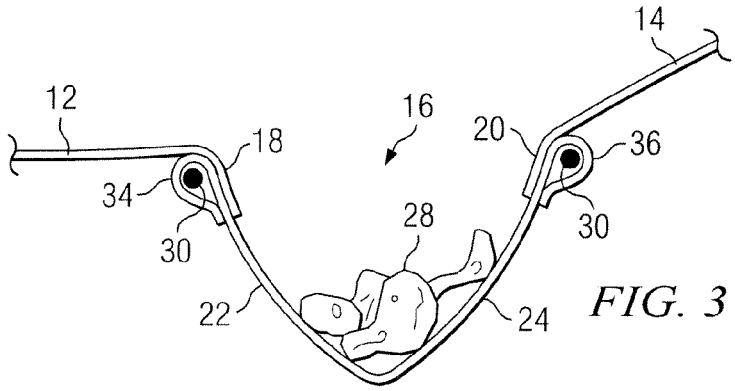
FIG. 3 illustrates a cross section view of a portion of the embodiment of FIG. 1 indicated by the numerals III-IV showing an open trough with food debris therein.
Figure 4:
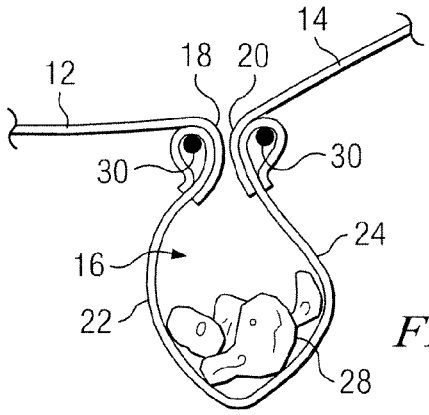
FIG. 4 illustrates a cross section view of a portion of the embodiment of FIG. 1 indicated by the numerals III-IV showing a closed trough with food debris therein.

The trough 16 portion of the dining bib 10 is shaped substantially in the form of a letter V in cross section as shown in FIG. 3, with the size of the letter V diminishing toward the ends at the left and right (first and second sides, respectively) of the dining bib 10. The trough 16 is formed by a forward side 22 and a rearward side 24 as shown in FIGS. 3 and 4 to be described. The table cover 12 portion of the dining bib 10 includes a bolster 40 disposed around a forward side and the left and right sides of the table cover 12. The bolster is formed as a hollow tube with the coated nylon fabric sewn to the table cover 12. The bolster 40 is filled with a resilient stuffing (not shown) such as a resin-bonded polyester quilt batting (for example, available from Hobbs Bonded Fibers, Waco, Tex. 76702 or www.hobbsbondedfibers.com), which negates the need to inflate the bolster, thus simplifying the use of the dining bib 10. The purpose of the stuffing is to maintain the tubular shape of the bolster 40 as it loops around the perimeter of the table cover 12, yet retains sufficient flexibility to allow the bolster 40 to be bent during installation or removal of the dining bib 10. The bolster 40 functions as a sidewall or fence around the perimeter of the table cover 12, forming a basin in combination with the table cover 12 to contain spills of liquid or solid food material during dining.

Further shown in FIG. 1 is a drawstring 30, with the first and second ends of the drawstring 30 indicated as emerging from first and second openings 32 respectively in a rearward surface of the table cover 12 and an adjacent location across the trough 16 in the rearward side 24 of the trough 16. The drawstring 30 is also shown at the opposite end of the trough 16 passing from a third opening 32 in the rearward surface of the table cover 12 into a fourth opening 32 located across the trough 16 in a rearward side 24 of the trough 16. The drawstring 30 feature enables repeated closing and opening of the trough 16. The drawstring 30 may be any suitable cord provided in the form of a shoe lace, for example, or other cord product, including braided or woven cord materials. In use, as the free ends of the drawstring 30 are pulled away from the first and second openings 32, the material of the dining bib 10 close to the trough 16, including the trough 16 is drawn together, closing the open upper portion of the trough 16 to enclose and contain the food debris 28 (shown in FIG. 3) until it can be discarded. The portions of the drawstring 30 not visible in FIG. 1 are disposed in narrow passages within the forward and rearward side walls 22, 24 proximate the upper edges of the trough sides 22, 24. The drawstring embodiment illustrated in FIG. 3 is provided to represent the use of a drawstring closure, and persons skilled in the art will understand that there are a number of ways to arrange a drawstring closure for the trough 16 to enclose and retain the food debris 28 contents within the trough 16 until it can be discarded. There is also a variety of ways to tie the ends of the drawstring 30 to secure the closure of the trough until it may be emptied. The embodiment shown has the advantage that most of the drawstring 30 is not exposed to the food debris that may be deposited upon the dining bib 10 during use.

Continuing with FIG. 1, the bib extension 14 is shaped to provide a protective panel covering the wearer's torso when seated in a dining position at a table, with an opening 46 to accommodate the wearer's neck. A first strap 42 and a second strap 44 may be provided with a fastening mechanism to secure the ends of the first 42 and second 44 straps around the wearer's neck to retain the bib extension in place upon the wearer's body. The fastening mechanism shown in FIG. 1 includes a button 50 on the first strap 42 and a curved slot 52 disposed on the end of the second strap 44. The curved slot 52 is similar to the curved slot found on a fastener commonly used to secure the twisted open end of a bread loaf bag, for example. This mechanism enables a quick closure of the ends of the first 42 and second 44 straps. Some alternative fastening mechanisms will be described in FIGS. 5, 6, and 7.

Figure 2:
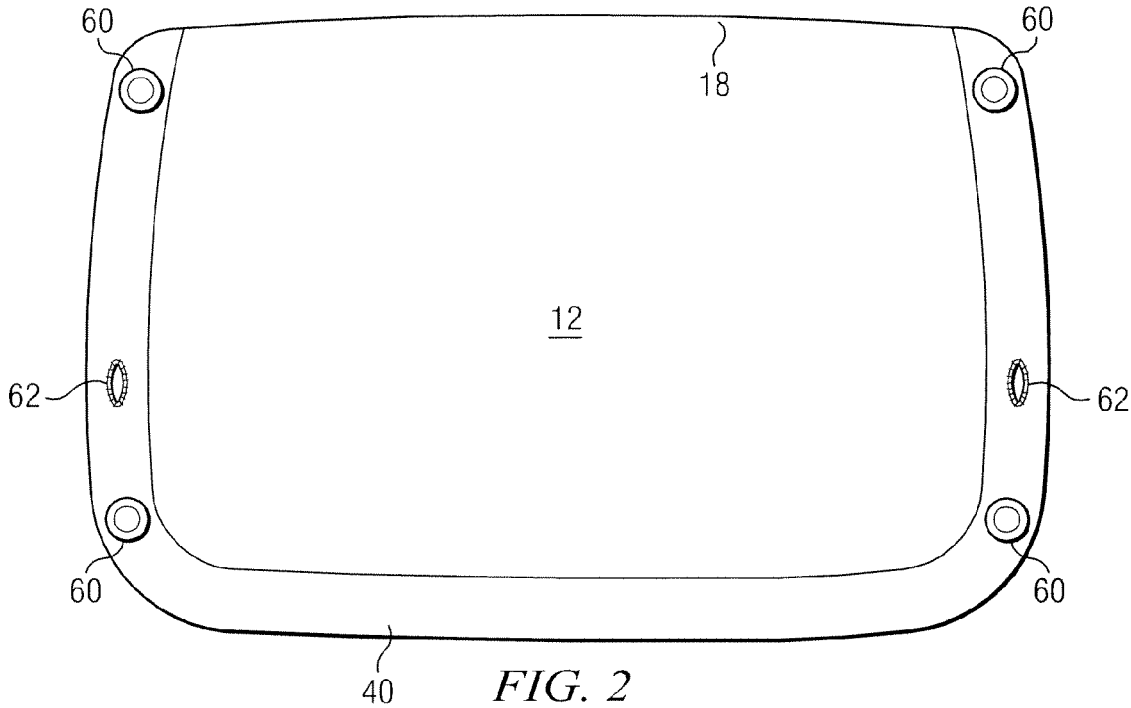
FIG. 2 illustrates an underside view of a dining bib according to an alternate embodiment of the present invention.

FIG. 2 illustrates an underside view of the table cover portion 12 of the dining bib 10 according to an alternate embodiment of the present invention. This embodiment includes several releasable fasteners 60 such as plastic suction cups attached to the underside of the perimeter of the table cover 12 portion of the dining bib 10. The suction cups provide for attaching or securing the table cover 12 of the dining bib 10 to the surface of the table when in use to maintain the dining bib 10 in a fully open orientation to fulfill its function of retaining food debris within the basin and trough. Other examples of releasable fasteners include small spring-loaded clamps or clips, magnets (for steel surfaced tables) and other equivalent devices (not shown). Also shown in FIG. 2 are first and second button holes 62 formed in the fabric of the bolster 40, one in the underside surface of the bolster 40 on each of the left and right sides. These button holes 623 are provided for draining water to speed drying time when the dining bib 10 is washed. These draining openings could alternatively be protected by a cement adhesive, instead of binding the edges of a formed opening with sewing thread material, or by the use of small grommets (such as an open rivet).

FIG. 3 illustrates a cross section view of a portion of the embodiment of FIG. 1 indicated by the numerals III-IV showing an open trough 16 with food debris 28 therein. further illustrated in FIG. 3, showing an end view thereof, are the drawstring 30 and the respective passages 34 and 36 disposed along the rearward side 18 of the table cover 12 and the upper portion 20 of the bib extension 14. The narrow passages 34, 36 may be formed as flaps of material sewn to the forward 22 and rearward 24 sides of the trough 16. FIG. 4 illustrates a cross section view of a portion of the embodiment of FIG. 1 indicated by the numerals III-IV showing a closed trough 16 with food debris 28 therein, when the drawstring 30 is drawn up to gather the perimeter portions 18, 20 together. All of the structures of FIG. 3 are shown in FIG. 4 and bear the same reference numbers.

Figure 5:
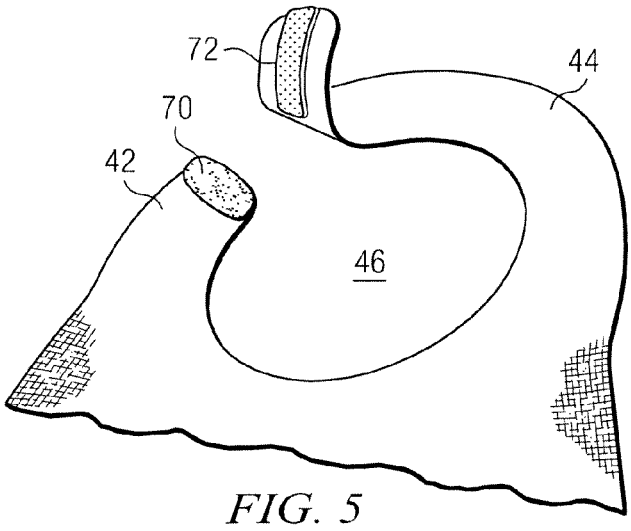
FIG. 5 illustrates a portion of the dining bib having a first alternate fastening apparatus.

FIG. 5 illustrates a portion of the dining bib having a first alternate fastening apparatus. A first portion 70 of a hook and loop fastener is attached to the first strap 42 and a second portion of the hook and loop fastener 72 is shown attached to the underside of the second strap 44. The second portion of the hook and loop fastener 72 is shown as a strip disposed along the length dimension of the strap 44 to enable adjustment of the closure of the straps around the wearer's neck.

Figure 6:
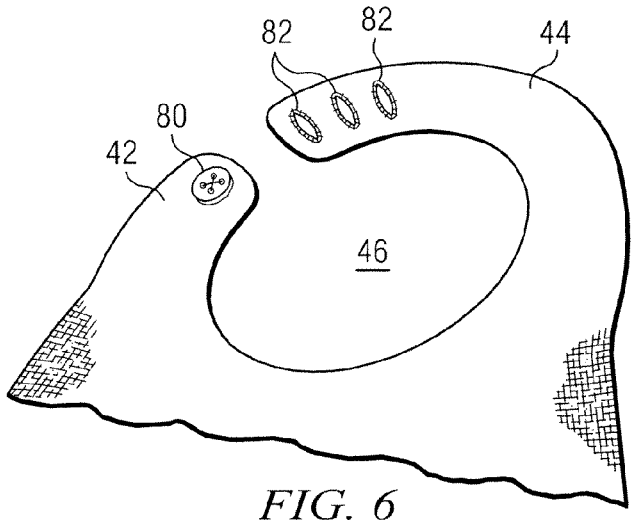
FIG. 6 illustrates a portion of the dining bib having a second alternate fastening apparatus.

FIG. 6 illustrates a portion of the dining bib having a second alternate fastening apparatus. A button 80 is attached to the first strap 42 and a series of button holes 82 are shown disposed along the length of the second strap 44 to permit adjustment of the closure of the straps around the wearer's neck.

Figure 7:
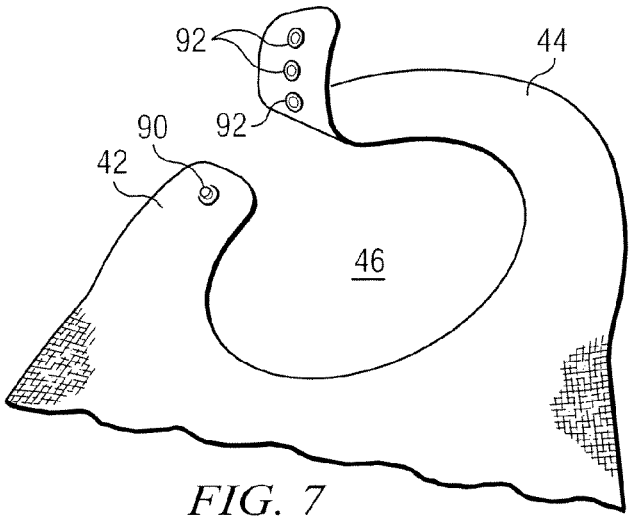
FIG. 7 illustrates a portion of the dining bib having a third alternate fastening apparatus.

FIG. 7 illustrates a portion of the dining bib having a third alternate fastening apparatus. A first member 90 (e.g., the male portion) of a snap fastener is shown attached to the end of the first strap 42 and a series of second members (e.g., the female portion) is shown attached to the end of the second strap 44 to permit adjustment of the closure around the wearer's neck.

Figure 8:
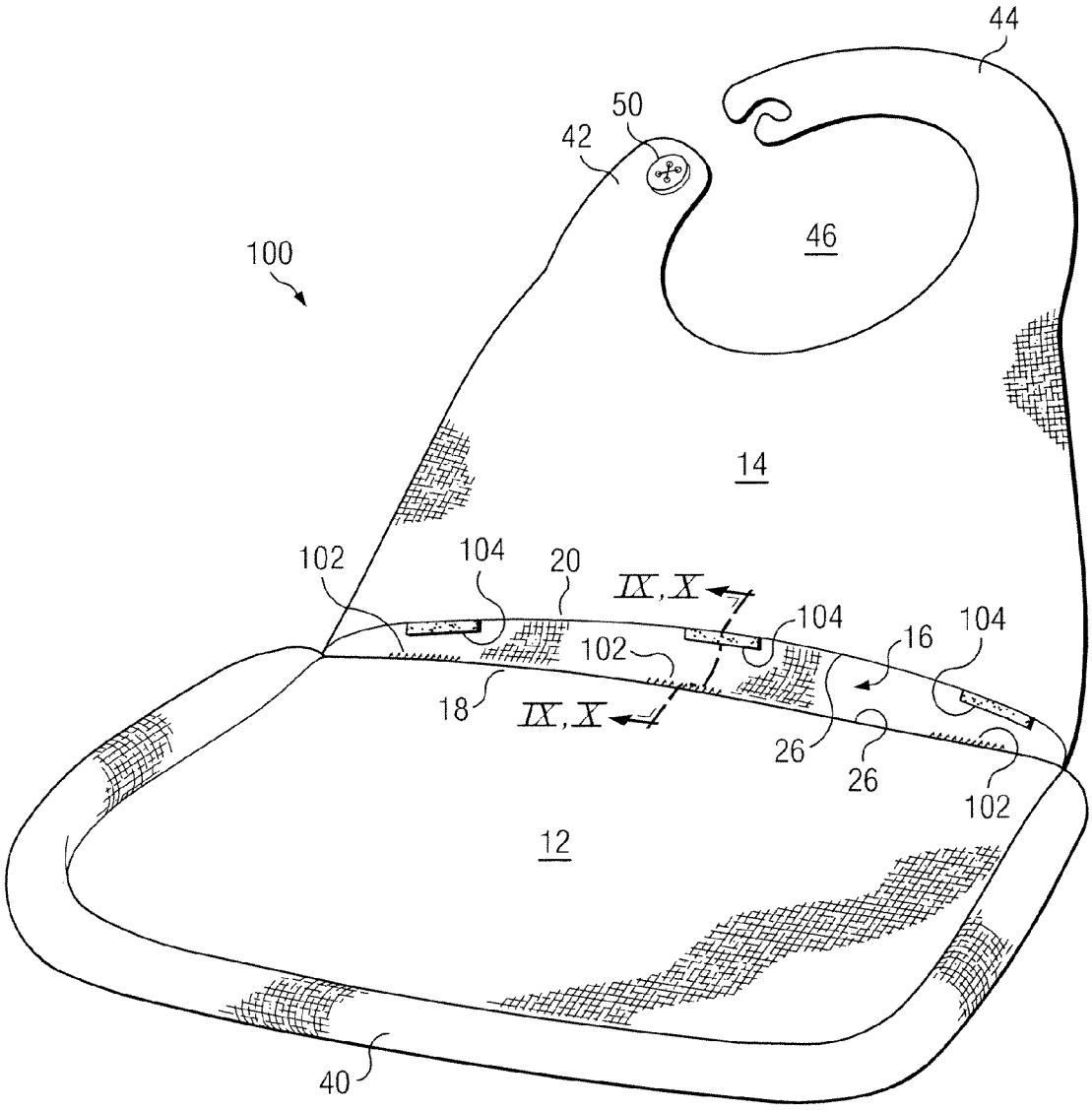
FIG. 8 illustrates an alternate embodiment of the invention depicted in FIG. 1.

FIG. 8 illustrates an alternate embodiment of the dining bib depicted in FIG. 1 that shows an alternate method of providing closure of the trough 16. Dining bib 100 contains the same structural features of dining bib 10 except for the use of hook 102 and loop 104 fasteners along the seams 26 of the trough 16. The hook 102 and loop 104 fastening assembly enables repeated closing and opening of the trough 16. While the hook 102 and loop 104 fasteners are shown in three locations along the seam 26, other similar arrangements are entirely acceptable. Further, while the hook 102 fasteners are shown on the rearward side 18 of the table cover 12 and the loop 104 fasteners are shown on the lower portion 20 of the bib extension 14, the fastening elements 102 and 104 could as easily be interchanged without detriment to their function of securing closure of the trough to contain food debris 28 as the dining bib 100 is removed and carried away for cleaning.

Figure 9:
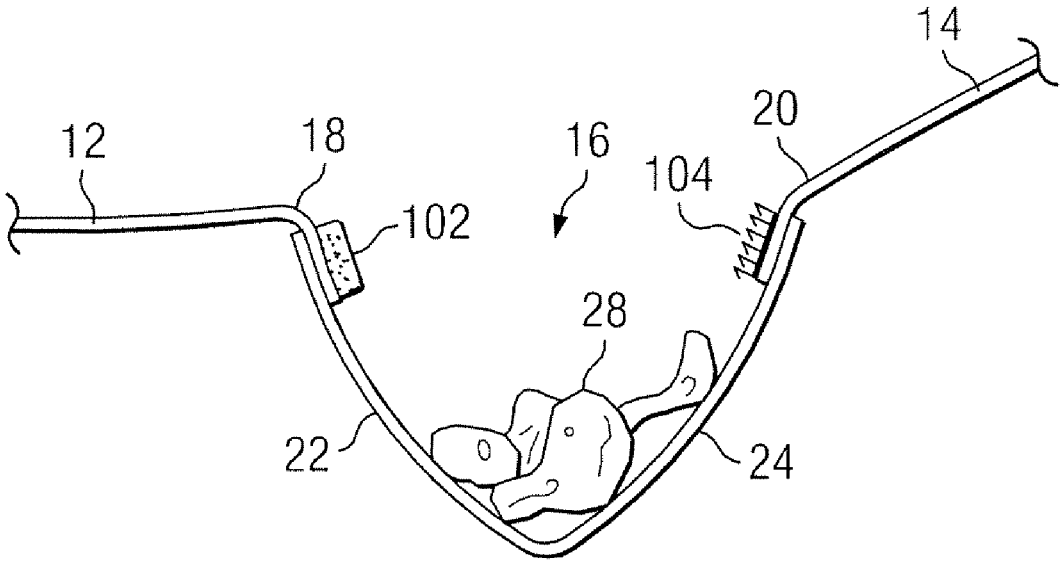
FIG. 9 illustrates a cross section view of a portion of the embodiment of FIG. 8 indicated by the numerals IX-X showing an open trough with food debris therein.

FIG. 9 illustrates a cross section view of a portion of the embodiment of FIG. 8 indicated by the numerals IX-X showing an open trough 16 with food debris 28 therein. The hook 102 fastener is shown attached to the forward side 22 of the trough 16 adjacent the rearward side 18 of the table cover. The loop 104 fastener is depicted attached to the rearward side 24 of the trough 16 adjacent the lower portion 20 of the bib extension 14.

Figure 10:
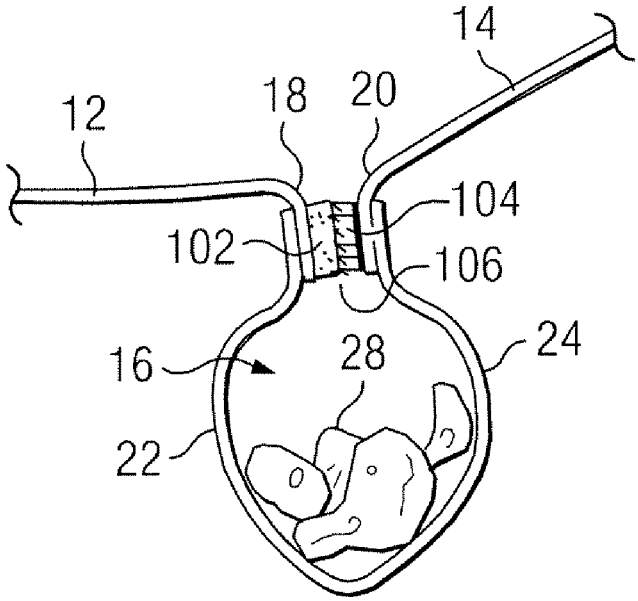
FIG. 10 illustrates a cross section view of a portion of the embodiment of FIG. 8 indicated by the numerals IX-X showing a closed trough with food debris therein.

FIG. 10 illustrates a cross section view of a portion of the embodiment of FIG. 8 indicated by the numerals IX-X showing a closed trough 16 with food debris 28 enclosed therein. The hook 102 fastener attached to the forward side 22 of the trough 16 adjacent the rearward side 18 of the table cover and the loop 104 fastener attached to the rearward side 24 of the trough 16 adjacent the lower portion 20 of the bib extension 14 are joined together to form a composite joint 106, thereby closing the trough 16 to enclose the food debris 28 there within.

To summarize, the foregoing description details the structure of the following dining bib embodiments. In one embodiment, a dining bib is disclosed comprising a table cover having a shape and size approximating an individual place mat for a dining position; a bib extension of said table cover extending upward proximate a rearward side of said table cover; a trough formed between said rearward side of said table cover and a lower portion of said bib extension for accumulating food or liquid debris spilled upon said table cover or said bib extension, wherein an upper perimeter of said trough is defined by the junction of said trough with said rearward side of said table cover and said lower portion of said bib extension, said trough extending downward from said upper perimeter, and said table cover, bib extension and trough are formed of a water repellant fabric into a single structure; a drawstring closure mechanism surrounding and retained within said upper perimeter of said trough to enable closing said trough; and a bolster disposed around and extending upward from the perimeter of said table cover on the left, forward , and right sides thereof, wherein a first end and a second end of said bolster are attached to said bib extension at respective left and right sides thereof, thereby forming a basin by said table cover, bib extension, and bolster in combination.

In another embodiment, a dining bib is disclosed comprising: a table cover having a shape and size approximating an individual place mat for a dining position; a bib extension of said table cover extending upward proximate a rearward side of said table cover; a trough formed between said rearward side of said table cover and a lower portion of said bib extension for accumulating food or liquid debris spilled upon said table cover or said bib extension, wherein an upper perimeter of said trough is defined by the junction of said trough with said rearward side of said table cover and said lower portion of said bib extension, said trough extending downward from said upper perimeter, and said table cover, bib extension and trough are formed of a water repellant fabric into a single structure; a bolster disposed around and extending upward from the perimeter of said table cover on the left, forward , and right sides thereof, wherein a first end and a second end of said bolster are attached to said bib extension at respective left and right sides thereof, thereby forming a basin by said table cover, bib extension, and bolster in combination; and a plurality of releasable fasteners disposed under the perimeter of said table cover to enable securing said table cover portion of said dining bib to a table surface during use.

Other embodiments may include various combinations of the features described herein. For example, persons skilled in the art will understand that various fastening devices and mechanisms my be substituted for the releasable fasteners, drawstrings, hook and loop fasteners, buttons, snap fasteners, magnets, etc. without departing from the concepts and principles of the present invention. Similarly, various materials may be substituted for the ones used in the illustrative embodiments while still retaining the desired function and properties of the illustrated material. Thus, while the invention has been shown in only a few of its intended forms, it is not thus limited but is susceptible to various changes and modifications without departing from the spirit thereof.

What is claimed is:

1. A dining bib, comprising:

a table cover having a shape and size approximating an individual place mat for a dining position;

a bib extension of said table cover extending upward proximate a rearward side of said table cover;

a trough formed between said rearward side of said table cover and a lower portion of said bib extension for accumulating food or liquid debris spilled upon said table cover or said bib extension, wherein an upper perimeter of said trough is defined by the junction of said trough with said rearward side of said table cover and said lower portion of said bib extension, said trough extending downward from said upper perimeter, and said table cover, bib extension and trough are formed of a water repellant fabric into a single structure;

a closure mechanism comprising a drawstring surrounding and retained within said upper perimeter of said trough to enable repeatably closing and opening said trough; and a bolster disposed around and extending upward from the perimeter of said table cover on the left, forward , and right sides thereof, wherein a first end and a second end of said bolster are attached to said bib extension at respective left and right sides thereof, thereby forming a basin by said table cover, bib extension, and bolster in combination.

2. The dining bib of claim 1, wherein said bib extension comprises at least one strap portion extending from one side thereof for surrounding a wearer's neck to support said bib extension upon said wearer's body, a distal end of said strap portion being securable to a second, opposite side of said bib extension.

3. The dining bib of claim 2, wherein said distal end of said strap portion of said bib extension is secured to said bib extension using a fastening device selected from the group consisting of hook-and-loop, button-and-button hole, button and bread bag closure, and snap fastener.

4. The dining bib of claim 2, wherein said distal end of said strap portion of said bib extension is adjustably secured to said bib extension using a fastening device selected from the group consisting of hook-and-loop, button-and-button hole, button and bread bag closure, and snap fastener.

5. The dining bib of claim 1, wherein said combination of said table cover, bib extension and trough are formed together at their adjoining boundaries using liquid-resistant sewn seams.

6. The dining bib of claim 1, wherein said drawstring closure comprises a string passed through retaining passages disposed around said perimeter such that first and second ends of said string may be pulled and secured together to draw and close the perimeter of the trough to retain said food debris within the trough as said trough is removed from use.

7. The dining bib of claim 1, wherein said closure mechanism is alternatively provided by at least one hook and loop fastener assembly disposed along said upper perimeter of said trough to enable repeatably closing and opening said trough.

8. The dining bib of claim 1, wherein said bolster has sufficient rigidity as a frame to maintain said basin form while retaining sufficient flexibility to facilitate installation, removal, and cleaning of said dining bib without requiring inflation of said bolster.

9. The dining bib of claim 1, wherein said bolster is given form by a resilient stuffing material disposed therewithin.

10. The dining bib of claim 1, wherein said bolster includes at lease one drain orifice disposed on an underside surface of said bolster for faster drying following washing of the bolster.

11. A dining bib, comprising:

a table cover having a shape and size approximating an individual place mat for a dining position;

a bib extension of said table cover extending upward proximate a rearward side of said table cover;

a trough formed between said rearward side of said table cover and a lower portion of said bib extension for accumulating food or liquid debris spilled upon said table cover or said bib extension, wherein an upper perimeter of said trough is defined by the junction of said trough with said rearward side of said table cover and said lower portion of said bib extension, said trough extending downward from said upper perimeter, and said table cover, bib extension and trough are formed of a water repellant fabric into a single structure;

a bolster disposed around and extending upward from the perimeter of said table cover on the left, forward , and right sides thereof, wherein a first end and a second end of said bolster are attached to said bib extension at respective left and right sides thereof, thereby forming a basin by said table cover, bib extension, and bolster in combination; and a plurality of releasable fasteners disposed under the perimeter of said table cover to enable securing said table cover portion of said dining bib to a table surface during use.

12. The dining bib of claim 11, wherein said bib extension comprises at least one strap portion extending from one side thereof for surrounding a wearer's neck to support said bib extension upon said wearer's body, a distal end of said strap portion being securable to a second, opposite side of said bib extension.

13. The dining bib of claim 12, wherein said distal end of said strap portion of said bib extension is secured to said bib extension using a fastening device selected from the group consisting of hook-and-loop, button-and-button hole, button and bread bag closure, and snap fastener.

14. The dining bib of claim 12, wherein said distal end of said strap portion of said bib extension is adjustably secured to said bib extension using a fastening device selected from the group consisting of hook-and-loop, button-and-button hole, button and bread bag closure, and snap fastener.

15. The dining bib of claim 11, wherein said combination of said table cover, bib extension and trough are formed together at their adjoining boundaries using liquid-resistant sewn seams.

16. The dining bib of claim 11, wherein said releasable fasteners are suction cups.

17. The dining bib of claim 11, wherein said bolster has sufficient rigidity as a frame to maintain said basin form while retaining sufficient flexibility to facilitate installation, removal, and cleaning of said dining bib without requiring inflation of said bolster.

18. The dining bib of claim 11, wherein said bolster is given form by a resilient stuffing material disposed therewithin.

19. The dining bib of claim 11, wherein said bolster includes at lease one drain orifice disposed on an underside surface of said bolster for faster drying following washing of the bolster.

20. A dining bib, comprising:

a table cover having a shape and size approximating an individual place mat for a dining position;

a bib extension of said table cover extending upward proximate a rearward side of said table cover;

a trough formed between said rearward side of said table cover and a lower portion of said bib extension for accumulating food or liquid debris spilled upon said table cover or said bib extension, wherein an upper perimeter of said trough is defined by the junction of said trough with said rearward side of said table cover and said lower portion of said bib extension, said trough extending downward from said upper perimeter, and said table cover, bib extension and trough are formed of a water repellant fabric into a single structure;

a closure mechanism comprising a drawstring surrounding said upper perimeter of said trough to enable repeatably closing and opening said trough;

a bolster disposed around and extending upward from the perimeter of said table cover on the left, forward , and right sides thereof, wherein a first end and a second end of said bolster are attached to said bib extension at respective left and right sides thereof, thereby forming a basin by said table cover, bib extension, and bolster in combination; and a plurality of releasable fasteners disposed under the perimeter of said table cover to enable securing said table cover portion of said dining bib to a table surface during use.

21. The dining bib of claim 20, wherein said bib extension comprises at least one strap portion extending from one side thereof for surrounding a wearer's neck to support said bib extension upon said wearer's body, a distal end of said strap portion being securable to a second, opposite side of said bib extension.

22. The dining bib of claim 21, wherein said distal end of said strap portion of said bib extension is secured to said bib extension using a fastening device selected from the group consisting of hook-and-loop, button-and-button hole, button and bread bag closure, and snap fastener.

23. The dining bib of claim 21, wherein said distal end of said strap portion of said bib extension is adjustably secured to said bib extension using a fastening device selected from the group consisting of hook-and-loop, button-and-button hole, button and bread bag closure, and snap fastener.

24. The dining bib of claim 20, wherein said combination of said table cover, bib extension and trough are formed together at their adjoining boundaries using liquid-resistant sewn seams.

25. The dining bib of claim 20, wherein said drawstring closure comprises a string passed through retaining passages disposed around said perimeter such that first and second ends of said string may be pulled and secured together to draw and close the perimeter of the trough to retain said food debris within the trough as said trough is removed from use.

26. The dining bib of claim 20, wherein said bolster has sufficient rigidity as a frame to maintain said basin form while retaining sufficient flexibility to facilitate installation, removal, and cleaning of said dining bib without requiring inflation of said bolster.

27. The dining bib of claim 20, wherein said bolster is given form by a resilient stuffing material disposed therewithin.

28. The dining bib of claim 20, wherein said closure mechanism is alternatively provided by at least one hook and loop fastener assembly disposed along said upper perimeter of said trough to enable repeatably closing and opening said trough.

29. The dining bib of claim 20, wherein said releasable fasteners are suction cups.

* * * * *